United States Patent [19]

Brown

[11] Patent Number: 5,005,379

[45] Date of Patent: Apr. 9, 1991

[54] AIR CONDITIONING SYSTEM

[76] Inventor: Michael E. Brown, 650 Horizons East - Apt. 101, Boynton Beach, Fla. 33435

[21] Appl. No.: 375,825

[22] Filed: Jul. 5, 1989

[51] Int. Cl.[5] ..... F25D 17/02

[52] U.S. Cl. ..... 62/434; 62/440

[58] Field of Search ..... 62/238.6, 238.7, 510, 62/440, 272, 285, 434; 237/2 B; 165/21, 27, 28, 58

[56] References Cited

U.S. PATENT DOCUMENTS

| | | | |
|---|---|---|---|
| 316,292 | 4/1885 | Rankin . | |
| 2,257,975 | 10/1941 | Miller et al. | 165/21 |
| 2,274,153 | 2/1942 | Miller et al. | 165/21 X |
| 2,343,467 | 3/1944 | McGrath | 165/21 X |
| 2,359,624 | 10/1944 | Crawford | 165/21 X |
| 3,181,311 | 5/1965 | Latzer | 62/440 |
| 3,850,007 | 11/1974 | McFarlan | 62/272 X |
| 4,653,287 | 3/1987 | Martin, Jr. | 237/2 B X |
| 4,697,434 | 10/1987 | Yuyama | 237/2 B X |

*Primary Examiner*—LLoyd L. King

*Attorney, Agent, or Firm*—Jack N. McCarthy

[57] ABSTRACT

An air conditioning system has a refrigeration system that supplies a refrigerant to an evaporator coil enclosed in a chiller tank. A low temperature coolant in the chiller tank is then refrigerated by the evaporator coil. The coolant is then pumped from the chiller tank through a spiral wall pipe in an area to be air conditioned, removing heat by conduction, convection, and evaporative cooling, and returned to the chiller tank to be cooled and recirculated. The coolant in the chiller tank is maintained at a desired temperature by the refrigeration system. The temperature in the conditioned area is controlled by the temperature and flow of the coolant in the spiral wall pipe. A heating system supplies hot water to the above air conditioning system while bypassing the refrigeration system. Humidification and cleaning are achieved by an overhead pipe which is perforated, and water or cleaning solution is pumped under low pressure and dispersed down onto the spiral wall pipe. Residue water or cleaning solution is then carried away by a condensate channel located under the spiral wall pipe.

11 Claims, 7 Drawing Sheets

AIR CONDITIONING SYSTEM

DESCRIPTION

1. Technical Field

This invention relates to an air conditioning system wherein a coolant has its temperature lowered and while still liquid, is pumped through spiral walled piping to achieve an air conditioning and dehumidification effect.

2. Background Art

A combination of thermodynamics, hydronics, the theory of refrigeration principles, as well as the use of electronics and electrical-mechanical equipment is included in this invention. Patents which were uncovered in a search made on the project on which subject application is based are set forth below: U.S. Pat. Nos. 316,292; 770,599; 3,939,914; 4,019,581; 4,286,667; and 4,559,999.

3. Disclosure of Invention

An object of this invention is to provide an air conditioning system which will cool by conduction, convection, and evaporative cooling.

A further object of this invention is to provide a coolant pipe having a spiral wall in a room to be conditioned by the removal of heat, a low temperature coolant flowing through the pipe maintaining the flow at the outer periphery of the pipe filling the spiral grooves in the outer surface.

A further object of this invention is to provide a coolant pipe for providing an efficient air conditioning system wherein said coolant pipe has internal spiral grooves extending along its length and extending radially outwardly from the interior to the exterior forming a spiral grooved outer surface having an increased area. A coolant flow is pumped through said coolant pipe to provide a flow of coolant through each of said internal spiral grooves.

Another object of this invention is to chill a coolant to a preset temperature and pump it through a spiral wall pipe in an area to remove latent and sensible heat therefrom through convection, conduction, and evaporation. The coolant draws the ambient air around it by convection, the chilled coolant removes heat by conduction within the pipe, and condensation on the outside of the pipe creates evaporative cooling.

Another object of the invention is to have a system using the principles of refrigeration to air condition and remove heat from a given space by chilling a coolant in a chiller tank and circulating it through continuous piping having internal and external spiral grooves located in the space. The chiller tank maintains the coolant at a below needed temperature and the condensate is removed by means of a channel located under the length of the piping. A heating system is incorporated within the system using a thermostat, which bypasses the cooling system and directs hot water through the continuous piping.

A further object of the invention is to increase the capacity of the air conditioning system by adding lengths of spiral wall pipe next to the original pipe; this will allow for faster response time of cooling, heating, and dehumidification. Flow through the additional spiral wall pipe will be controlled by a two-stage thermostat. With increases in capacity in the system, an increase in the refrigeration apparatus capacity will be required to compensate for the difference in water volume being piped through the additional spiral wall pipe.

A two-stage or variable speed pump controlled by the two-stage thermostat would be required to compensate for an increase of water volume necessary for additional spiral wall pipe.

Another object of the invention is to provide heat transfer by spiral wall piping which can be both rigid or flexible, allowing for both functional as well as decorative variations. The spiral wall pipe can traverse overhead in a structure, follow the perimeter of the structure, be mounted on walls to form various shapes, or be shaped to the contour of the structure.

It is a further object of the invention to achieve evaporative cooling with a spiral wall pipe when the superheated vapor in the air is carried to the pipe by convection; thus condensing on the spiral wall pipe. This effect causes evaporative cooling by condensing latent heat into water and carrying away the desuper-heated water vapor as it forms droplets, and falls into the drain channel and is carried away.

It is another object of the invention to provide additional evaporative cooling under low humidity conditions. An overhead parallel plain pipe is placed over the top of the spiral wall pipe with orifices placed therein along the bottom of the parallel straight pipe directing water onto the top of the spiral wall pipe. Water supplied to the straight pipe will come from a separate supply and control system.

It is another object of this invention to provide a self-cleaning system for cleaning the spiral wall pipe by directing water from the overhead parallel straight pipe of the evaporative cooling system when desired. A separate liquid control tank containing disinfectant and cleaning solutions can be directed through the straight pipe for discharge on the spiral wall piping.

A further object of the invention is to provide a condensate drain channel member under the spiral pipe to receive any condensation or leakage from the pipe, or water directly from the evaporative cooling straight pipe (water from the straight pipe coming from either the evaporative system or the self-cleaning system).

It is an object of this invention to provide a spiral wall pipe as a heat exchanger in a room wherein a coolant flows therethrough filling the internal spirals of the pipe.

It is another object of the invention to provide a pump with a capacity to provide a flow through the inner grooves of a spiral wall pipe, the pump capacity changing with a change in the number of spiral wall pipes used.

Another object of the invention is to provide a multiple pipe heat exchanger apparatus comprising a plurality of spiral wall pipes aligned one next to the other and supported over a drain channel member, a pipe being located over said top spiral wall pipe for spraying water on said spiral wall pipes for (1) evaporative cooling, and (2) cleaning.

It is a further object of the invention to provide a decorative cover strip to hide any unsightly pipes or supporting members, said strip acting as a deflector if a leak occurs in any pipe to keep any water spray substantially in the drain channel, away from the inner part of the room.

BEST MODE FOR CARRYING OUT THE INVENTION

Figure 1:
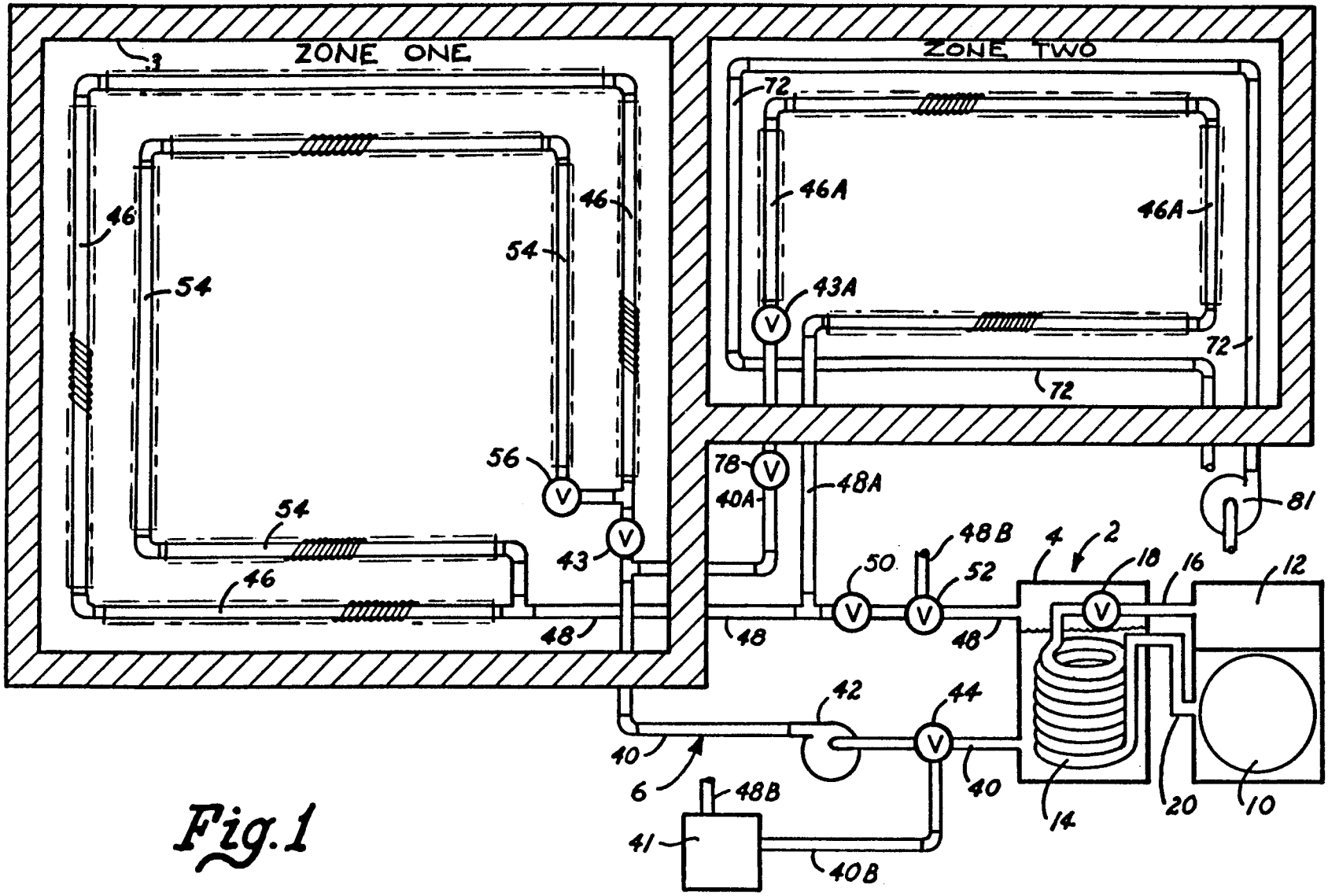
FIG. 1 is a schematic view of the air conditioning system having two zones, "ZONE ONE", having two stages.
Figure 2:
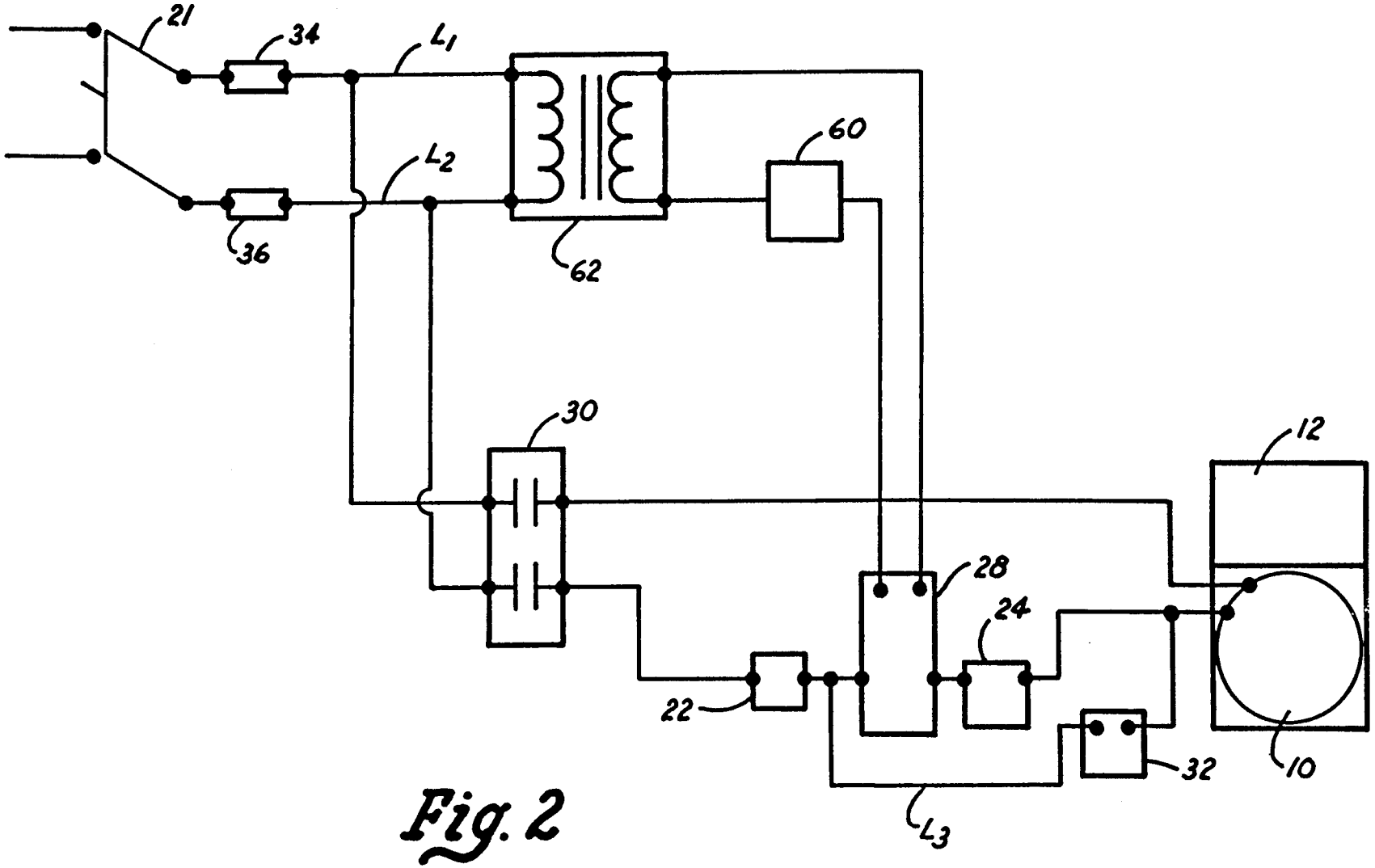
FIG. 2 is a separated schematic view of the electrical wiring for the control of the refrigeration apparatus.
Figure 3:
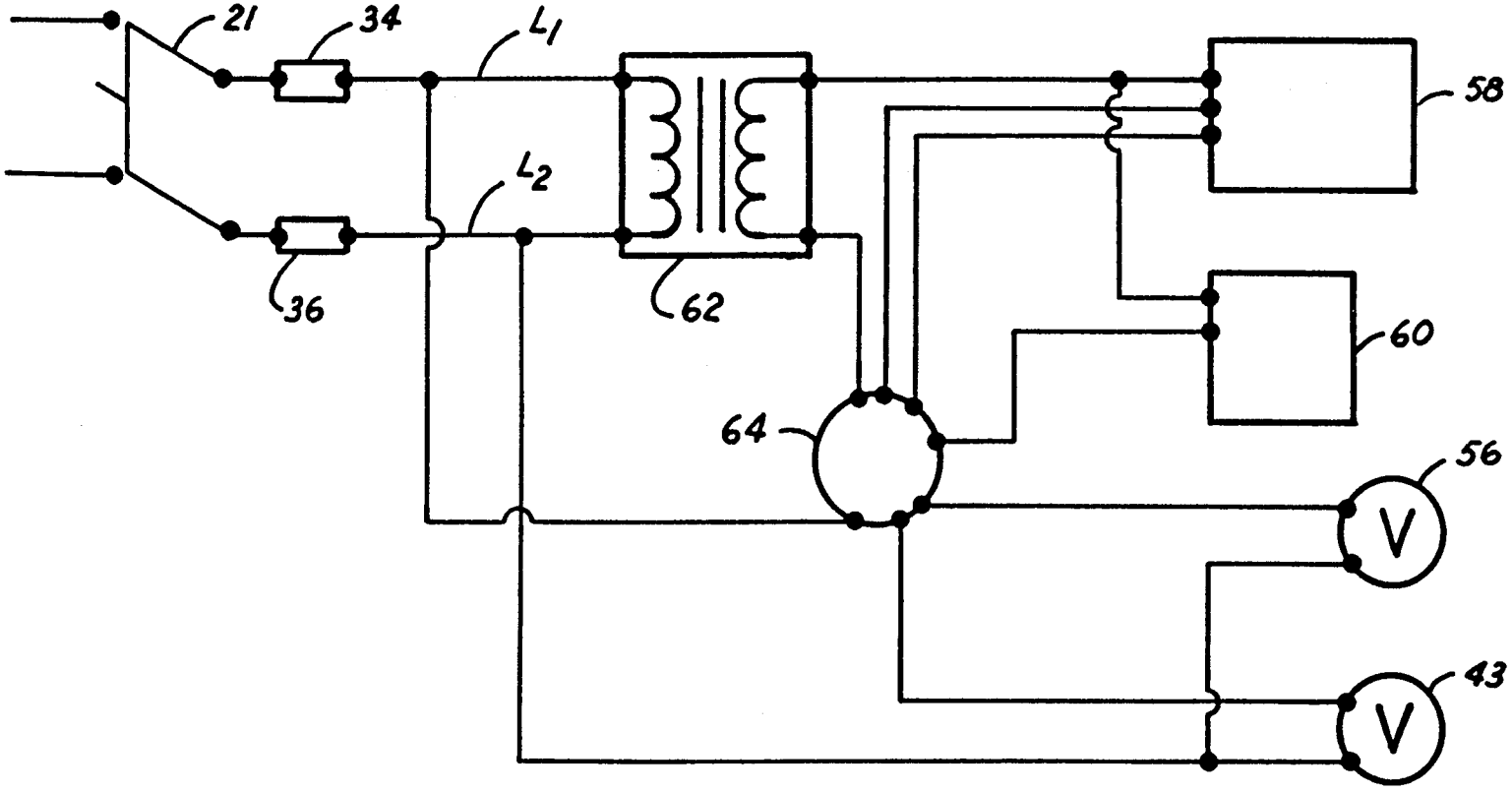
FIG. 3 is a separated schematic view of the electrical wiring for the control of solenoid operated on-off valves.

FIG. 1 shows an air conditioning system 1 for an enclosed area, such as a room 3, comprising three of the four main parts:

(1) a refrigeration apparatus 2;

(2) a chiller tank 4 for containing a volume of coolant, such as water, to be kept at a below needed temperature by the refrigeration apparatus 2; and (3) a piping and valving system 6 for directing a flow of said coolant from said chiller tank 4, or liquid from a hot water supply 41, around the upper periphery of a room and back to the chiller tank 4, or hot water supply 41, respectively, through a pipe, the pipe in the room providing the air conditioning being a spiral wall pipe 46 having spiral channels along the interior thereof extending through to the exterior thereof forming a spiral pipe wall.

FIGS. 3, 4, 5 and 6 show the fourth part—(4) an integrated control system to obtain the air conditioning desired. The integrated control system is shown in separate parts for clarity.

The refrigeration apparatus 2 comprises a conventional compressor 10 and condenser 12 with an evaporator coil 14 located within the chiller tank 4. The outlet of the condenser 12 is connected by piping 16 to an expansion valve 18; the expansion valve 18 is in turn connected to the inlet of an evaporator coil 14. The outlet of the evaporator coil 14 is connected to the inlet of the compressor 10 by piping 20. Condenser 12 directs high pressure refrigerant through piping 16 and expansion valve 18 to the evaporator coil 14 in chiller tank 4. Piping 20 returns low pressure refrigerant from the evaporator coil 14 back to the inlet of the compressor 10.

Controls for the refrigeration apparatus 2 (see FIG. 3) for operation comprise (1) an "ON-OFF" switch 21; (2) a normally open double pole magnetic contactor device 30 having a contactor located in Lines $L_1$ and $L_2$ near the voltage source, actuated by line voltage; (3) a low limit temperature control 22 located in one line $L_2$ with a sensor located in chiller tank 4; (4) a 24-volt activated humidistat relay 28 located in line $L_2$ after said low limit temperature control 22; (5) a low pressurestat control 24 located in line $L_2$ after said humidistat relay 28, said low pressurestat control 24 being connected to piping 20 at the low side of compressor 10 which senses return pressure from evaporator coil 14 and cycles compressor 10 on and off at a preset pressurestat setting; and (6) a high limit temperature control 32 with a sensor located in the coolant in chiller tank 4, said high limit temperature control 32 being located in a line $L_3$ connected at one end to line $L_2$ between low limit temperature control 22 and humidistat relay 28 and at its other end to line $L_2$ between low pressurestat control 24 and the compressor 10 to sense temperature rise of the coolant; the high limit temperature control 32 is placed in a control position by humidistat 60 opening humidistat relay 28 to allow higher temperature coolant to be pumped through the cooling system, allowing for the removal of latent heat in the form of condensation on spiral wall piping 46 without lowering the ambient temperature in the zone.

The low limit temperature control 22 and humidistat relay 28 are normally closed, and low pressurestat control 24 is normally open, so that when switch 21 is on, and heat removal is desired, voltage to the compressor 10 is controlled by the low pressurestat control 24.

When the low pressurestat control 24, which is set at a predetermined pressure, is not satisfied by the pressure of the refrigerant in piping 20, indicating a desired temperature in chiller tank 4, it closes, thereby applying the line voltage to the compressor 10 by turning it "ON". This low pressurestat control 24 cycles the compressor 10 "ON" and "OFF", maintaining the predetermined desired temperature of the coolant in chiller tank 4.

When the temperature of the coolant in chiller tank 4 approaches a predetermined low value, which indicates a malfunction in the system, the low limit temperature control 22 opens, thereby cutting off the voltage applied to the compressor 10.

In operation, the coolant from chiller tank 4 is pumped through a spiral wall pipe 46 in a room 3, "ZONE ONE", said pipe 46 having spiral channels along the interior thereof, extending through to the exterior thereof, forming a spiral wall, to remove heat from the room 3. FIG. 1 shows a pipe 40 extending from the bottom of the chiller tank 4 to a location in room 3. A circulating pump 42 is located in pipe 40 near chiller tank 4, and a solenoid operated two-way diverter valve 44 is located in pipe 40 between circulating pump 42 and the chiller tank 4. Diverter valve 44 is normally positioned to direct coolant flow from chiller tank 4 through pipe 40 to pump 42 for cooling. When heating is called for, the solenoid of solenoid operated two-way diverter valve 44 is actuated to direct a hot flow from a hot water supply 41 through pipe 40B to pipe 40 and pump 42, closing off chiller tank 4. Spiral wall pipe 46 is located around the upper periphery of room 3 and has an inlet end connected to pipe 40 by a solenoid operated on-off valve 43 and its other end is connected to a return pipe 48 which is in turn connected to the top of the chiller tank 4. A flow switch 50, to be hereinafter described, is located in return pipe 48 and a solenoid operated two-way diverter valve 52 is located in return pipe 48 between the flow switch 50 and the chiller tank 4. Diverter valve 52 is normally positioned to direct coolant flow to chiller tank 4 through return pipe 48. When heating is called for, the solenoid of solenoid operated two-way diverter valve 52 is actuated to direct the hot flow from return pipe 48 back to the hot water supply 41 through return pipe 48B, closing off chiller tank 4.

While a single stage of spiral wall pipe 46 can be used, a second stage can be used for the starting of the system when a predetermined large difference exists between the room temperature desired and present room temperature. The second stage would comprise a second spiral wall pipe 54 located next to, such as under, the spiral wall pipe 46 (shown to the inside in FIG. 1 for clarity). The inlet end would be connected to spiral wall pipe 46 just downstream of solenoid operated valve 43 and its other end connected to return pipe 48 below the connection of spiral wall pipe 46 to return pipe 48. A solenoid operated on-off valve 56 is located in spiral wall pipe 54 adjacent its connection to spiral wall pipe 46.

It is to be noted that when a two-stage spiral wall pipe 54 is used, a two-stage pump, or variable output pump, 42, is used to maintain the proper flow in the first stage spiral wall pipe 46, and the same proper flow in both first and second stage spiral wall pipes 46 and 54 when two pipes are used. The two-stage pump 42 would be controlled by the signal sent to each solenoid operated on-off valve 43 and 56. The signal to solenoid operated on-off valve 43 would turn on the first stage of pump 42 and the signal to solenoid operated on-off valve 56 would turn on the second stage of pump 42.

The area of room 3 is referred to as "ZONE ONE" and other zones can be added as required by the number of rooms. A "ZONE TWO" is shown in FIG. 1 with only one stage shown for clarity. A pipe 40A is shown connected to pipe 40 and extends into "ZONE TWO". A spiral wall pipe 46A is located around the upper periphery of "ZONE TWO" and has an inlet end connected to pipe 40A by a solenoid operated on-off valve 43A and its other end is connected to return pipe 48 by a return pipe 48A. When zones are added, the capacity of the refrigeration apparatus 2 is increased, as is auxiliary equipment, such as the size of the chiller tank 4, pump 42, number of thermostats, humidistats, etc.

A two-stage thermostat 58 and a humidistat 60 are located in room 3, "ZONE ONE", to control the temperature and humidity therein. The thermostat 58 and humidistat 60 function independently, but are interconnected so that if the temperature in the zone is satisfied, the humidistat 60 can provide its function to obtain a selected humidity.

In cooling, the two-stage thermostat 58 is set at two temperatures; a first stage is set at the temperature desired in the room 3, "ZONE ONE", and a second stage is set at a temperature just above the desired temperature.

Figure 4:
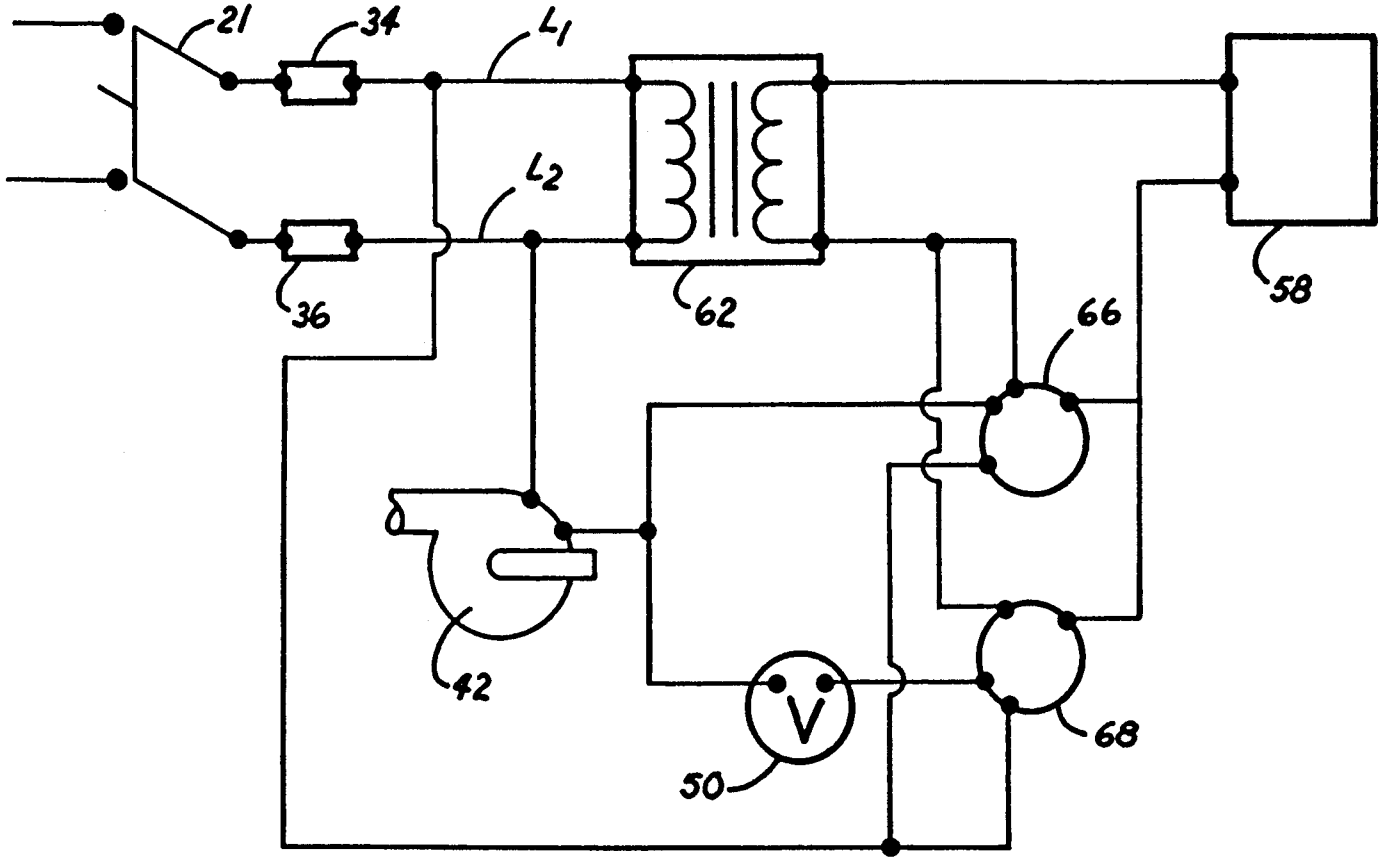
FIG. 4 is a separated schematic view of the electrical wiring for the control of the pump by a time delay relay and pump relay.

As seen in FIG. 4, thermostat 58 connects low voltage transformer 62 to solenoid relay 64 to independently actuate the solenoids of the solenoid actuated valves 43 and 56 by line voltage on lines $L_1$ and $L_2$, to arrive at the two temperatures set on the two stages thereof and to actuate the proper stage of pump 42. When the two-stage thermostat 58 calls for cooling in room 3, "ZONE ONE", any stage set at a temperature above the sensed temperature completes a series circuit from low voltage transformer 62 to solenoid relay 64, where the proper solenoid operated valve, 43, 56, will be actuated.

If the temperature in room 3 is above the temperature set in the second stage of the thermostat 58, both solenoid operated valves 43 and 56 are opened so that the coolant in pipe 40 will pass through both spiral wall pipes 46 and 54 and be directed back to the chiller tank 4 by return pipe 48; both stages of pump 42 are also activated. When the temperature in the room 3, "ZONE ONE", is brought to the temperature set in the second stage, the solenoid operated valve 56 is closed, also closing off the second stage of pump 42. If the temperature in the room 3, "ZONE ONE", is between the desired temperature set in the first stage and the temperature set in the second stage, only the solenoid operated valve 43 will be turned on with the first stage of pump 42.

Figure 5:
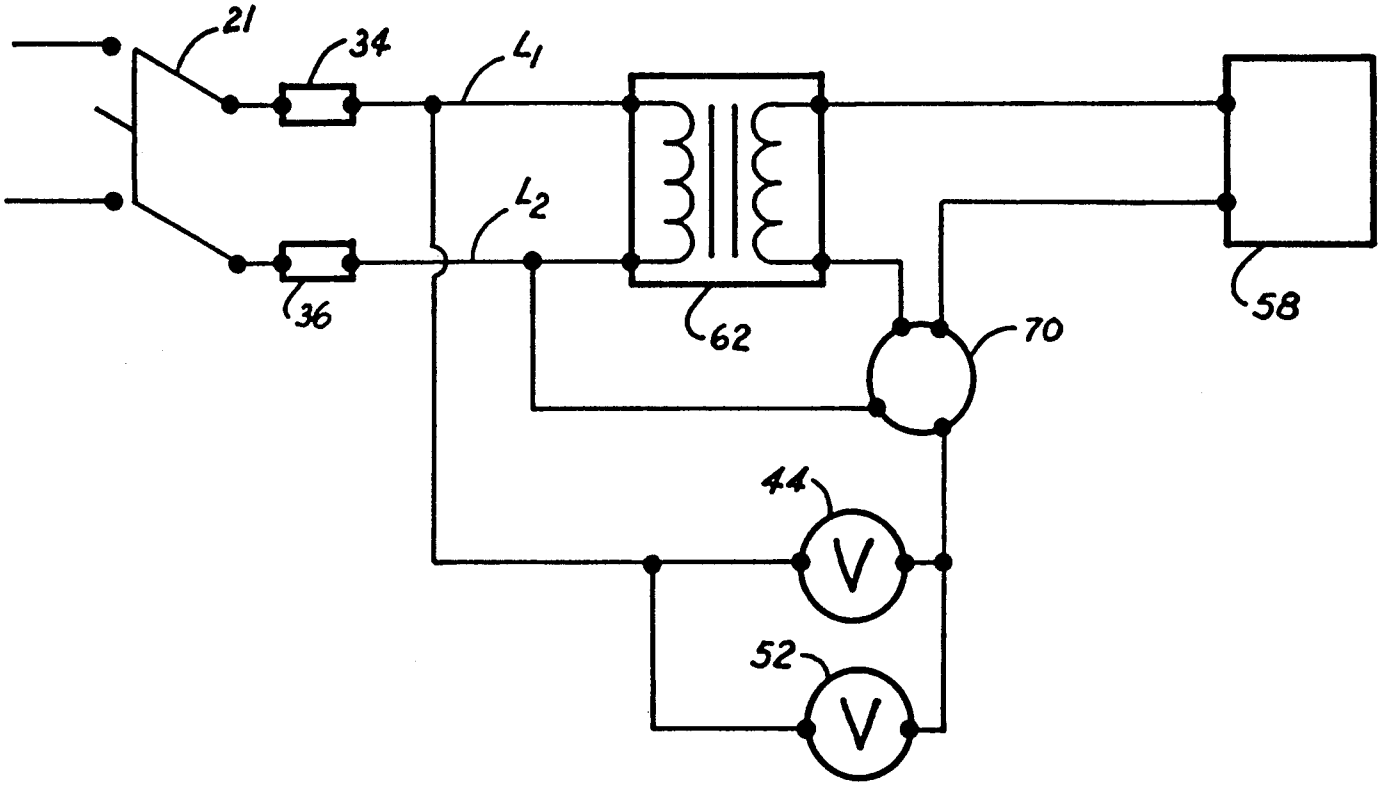
FIG. 5 is a separated schematic view of the electrical wiring for the control of the solenoid operated two-way diverter valves.

Further, as seen in FIG. 5, when the two-stage thermostat 58 calls for cooling in room 3, "ZONE ONE", it connects low voltage transformer 62 to a time delay relay 66 and a pump relay 68 to actuate them. Time delay relay 66 places line voltage across pump 42 for a predetermined time period to operate it to determine if the coolant is flowing properly from the chiller tank 4, through pipe 40, spiral wall pipe 46, return pipe 48, and flow switch 50 back into the chiller tank 4. Flow switch 50 is normally open, and closed by a predetermined flow therethrough from return pipe 48. No flow, or a flow below the predetermined set flow, would keep flow switch 50 open.

Pump relay 68 places line voltage across the open flow switch 50 so that if a proper predetermined flow is not obtained through return pipe 48, the pump 42 will not be kept on beyond the predetermined time period set in the time delay relay 66. If a proper predetermined flow is obtained through return pipe 48 closing flow switch 50, the pump 42 will continue to pump after the time delay relay 66 has cut off line voltage across pump 42, until the thermostat 58 is satisfied.

Figure 6:
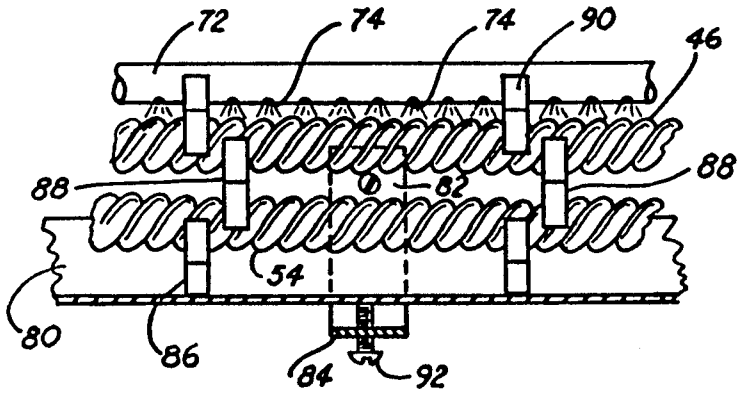
FIG. 6 is a side view of a mounted section of the spiral wall pipes, smaller plain pipe, pipe spacing members, with a portion of a supporting strap and drain channel removed.

In heating, the two-stage thermostat 58 is set at two temperatures; a first stage is set at the temperature desired in the room 3, "ZONE ONE", and a second stage is set at a temperature just below the desired temperature. When the two-stage thermostat 58 calls for heating in room 3, "ZONE ONE", the solenoid relay 64, time delay relay 66, and pump relay 68 are placed in operation as above, with heating relay 70 being actuated, as seen in FIG. 6, to place line voltage across the solenoid of the solenoid operated two-way diverter valves 44 and 52 to move them to their energized position connecting pipe 40B and hot water supply 41 to pipe 40 and the inlet of pump 42, while closing off pipe 40 to chiller tank 4, and connecting flow switch 50 to return pipe 48B and hot water supply 41, while closing off pipe 48 to chiller tank 4, respectively. The hot water is then passed through the piping and valving system 6 as the coolant was above, using the same integrated control system.

Thermostat 58 independently actuates the solenoids of the solenoid actuated valves 43 and 56, and the proper stages of pump 42, to arrive at the two temperatures set on the two stages thereof. When the two-stage thermostat 58 calls for heating in room 3, "ZONE ONE", any stage set at a temperature below the sensed temperature actuates solenoid relay 64, where the proper solenoid operated valve 43, 56, along with the proper pump stage, will be actuated.

If the temperature in room 3, "ZONE ONE", is below the temperature set in the second stage of the thermostat 58, both solenoid operated valves 43 and 56 are opened so that the hot liquid in pipe 40B will be pumped by pump 42 through diverter valve 44 into both spiral wall pipes 46 and 54 and be directed back to the hot water supply 41 by return pipe 48, diverter valve 52 and return pipe 48B. As in cooling, when the temperature in the room 3, "ZONE ONE", is brought up to the temperature set in the second stage, the solenoid operated valve 56 is closed. If the temperature in the room 3, "ZONE ONE", is between the desired temperature set in the first stage and the temperature set in the second stage, only the solenoid operated valve 43 will be turned on.

As when cooling, low voltage transformer 62 is connected to the time delay relay 66 and pump relay 68 to actuate them. This places line voltage across pump 42 for a predetermined time by time delay relay 66 and across the open flow switch 50 by pump relay 68. If a proper hot liquid flow is not obtained through return pipe 48, the pump 42 will not be kept on beyond the predetermined time period set in the time delay relay 66. If a proper predetermined flow is obtained through return pipe 48, closing flow switch 50, the pump 42 will continue to pump the hot liquid after the time delay relay 66 has cut off line voltage across pump 42, until the thermostat 58 is satisfied. The thermostat 58 will then cycle operation to maintain the temperature called for.

When humidistat 60 calls for removal of moisture in a zone, such as "ZONE ONE", and the temperature in the zone is satisfied, the humidistat 60 will place a low voltage across humidistat relay 28 opening it, thereby preventing the compressor 10 from coming on by low pressurestat control 24. This will permit the coolant temperature in chiller tank 4 to rise, allowing the coolant to remain below dew point temperature in the room 3, "ZONE ONE", to effect humidity removal in a zone without lowering the temperature in the zone as warmer coolant is being pumped through the system. When the temperature of the coolant reaches the high limit set on the high limit temperature control 32, the normally open control is closed to keep the coolant at the high temperature limit set on high limit temperature control 32. This action will cycle high limit temperature control 32 until the thermostat 58 calls for the cooling system to be actuated and turns off humidistat 60.

When it is necessary to maintain the humidity in a given zone without lowering the temperature, a differential pressure flow valve 78 is used. This valve can be manually operated or activated by a remote humidity sensor allowing for independent heat and/or humidity transfer in separate zones. Flow control valve 78 is located upstream of solenoid valve 43A, and controls the volume of flow of coolant circulating in spiral wall pipe 46A.

Figure 7:
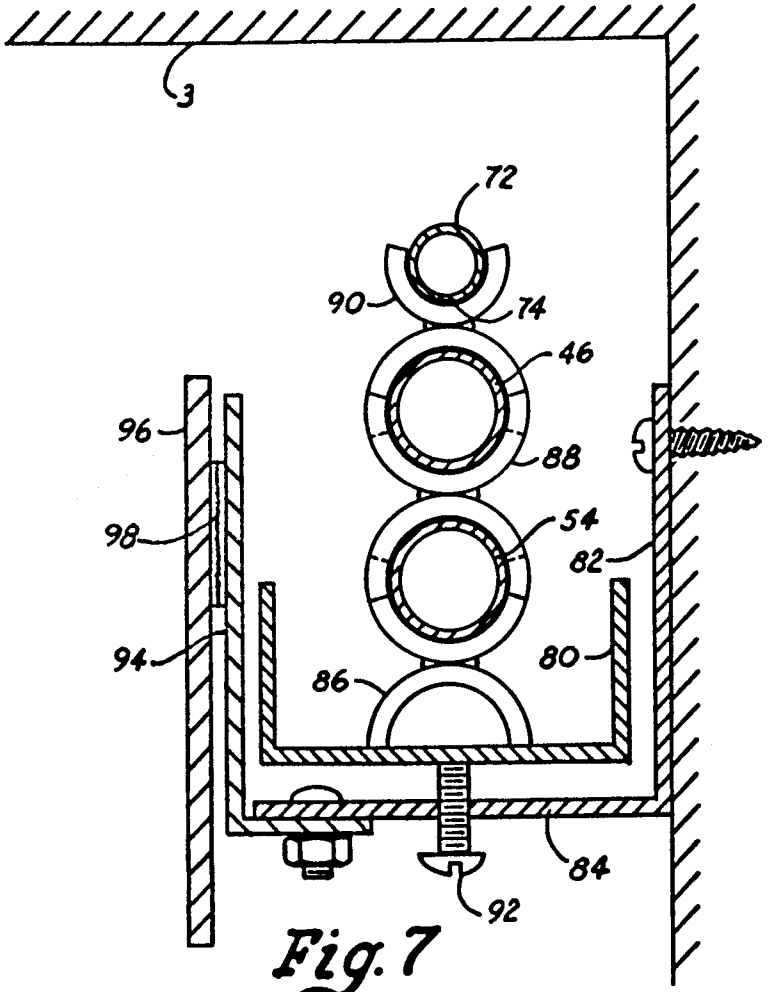
FIG. 7 is a cross-sectional view taken through a room showing the meeting of the ceiling and wall showing a supporting strap in section with a drain channel positioned therein for drain adjustment with the channel supporting the spiral wall pipes, small plain pipe, and pipe spacing members; a strap is located projecting upwardly from the outer edge of the supporting strap to support a decorative strip as by Velcro.

Under low humidity conditions, such as in the desert, the spiral wall cooling pipe can be additionally utilized to provide evaporative cooling. A plain pipe 72 is placed over the spiral wall pipe, shown to the outside of spiral wall pipe 46A in FIG. 1 for clarity, with orifices 74 thereunder (see FIGS. 6 and 7) to direct a spray of water onto the top of the spiral wall piping. This water will run along the external spiral grooves of spiral wall piping, such as 46A, before dropping from the spiral wall pipe onto a second stage pipe if used (such as a spiral wall pipe 54 not shown) or directly into a drain channel 80, positioned under the full length of the spiral wall piping. Discharge of water onto the spiral wall piping will provide evaporative cooling.

The water directed onto the top of the spiral wall piping has a separate water supply and control system. A humidistat can be connected through a low voltage transformer to a solenoid relay for controlling a pump 81 connected to a water supply. The humidistat turns the pump 81 on and off when it is preset at a relative humidity setting. For a simple control, pump 81 can be manually controlled by an "ON-OFF" switch to obtain the evaporative cooling when desired.

Plain pipe 72 can be used for cleaning any spiral wall pipe by having a separate manual control for pump 81. When the plain pipe 72 is used for cleaning, a cleaning solution can be placed in the water supply to help in maintaining the spiral wall pipes and channel 80 as clean as possible. Any approved cleaning agents can be used for this purpose.

Figure 8:
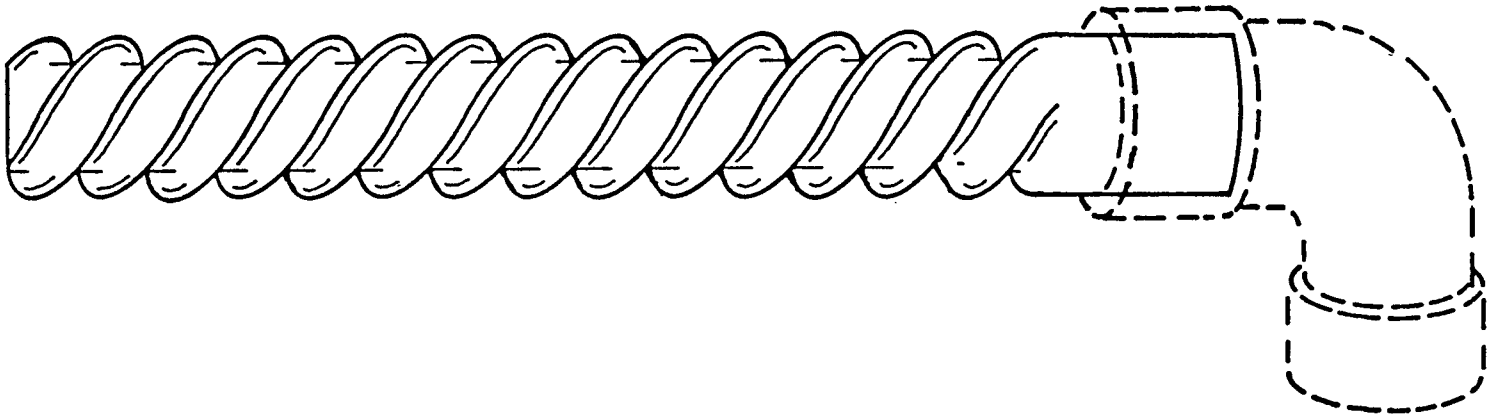
FIG. 8 is a side view of a portion of a spiral wall pipe having a plain end for receiving a connection such as a 90° elbow.

As shown in FIGS. 8 and 9, a supporting strap 82 is attached to the wall with a horizontal arm 84 extending therefrom. The supporting straps 82 are placed at spaced locations around the room to support the channel 80, spiral wall pipes 54 and 46, and straight pipe 72, along with spacing members 86, 88, and 90 located in said channel 80.

Spacing members 86, 88 and 90 comprise two "C" sections connected at the center of their curved back side; a series of spacing members 86 being located between spiral wall pipe 54 and the bottom of channel 80, a series of spacing members 88 being located between spiral wall pipes 54 and 46; and a series of spacing members 90 being located between plain pipe 72 and spiral wall pipe 46; the size of the "C", of the "C" sections, being formed to hold, or grip, the pipe intended for it.

Adjusting screws 92 are placed in arms 84 around the bottom of channel 80 for adjusting the positioning to achieve proper draining. The channel 80 has a drain to the exterior of the room; the bottom of channel 80 diverting any water to the drain.

An upstanding arm 94 is attached to the end of each arm 84 to extend upwardly on the inside of channel 80, away from the wall, and stacked pipes 54, 46 and 72. A decorative strip 96 can be attached to the arms 94 to provide an attractive appearance, covering the view of the straps 82, channel 80, and stacked pipes 54, 46 and 72; the strip 96 also provides a deflector for preventing water from spraying or leaking into the inside of the room. Velcro holding means 98 has been shown, but other attachment devices can be used.

While the principles of the invention have now been made clear in an illustrative embodiment, it will become obvious to those skilled in the art that many modifications in arrangement are possible without departing from those principles. The appended claims are, therefore, intended to cover and embrace any such modifications, within the limits of the true spirit and scope of the invention.

I claim:

1. An air conditioning system for removing heat from a room, said system having a length of spiral wall pipe for being located in a room, means for mounting said length of spiral wall pipe around the upper periphery of a room permitting upward air flow therearound, said spiral wall having a plurality of internal and external spiral grooves extending along the length of the pipe, a chiller tank for containing a coolant, means for regulating the temperature of said coolant, said spiral wall pipe having an inlet end, said inlet end being connected to said chiller tank as an inlet, said spiral wall pipe having an outlet end, said outlet end being connected to said chiller tank to return a coolant to said chiller tank, pump means connected to said spiral wall pipe for pumping a coolant through said spiral wall pipe to remove heat from a room.

2. A combination as set forth in claim 1 wherein said means for pumping a coolant through said spiral wall pipe provides a flow of coolant through said internal spiral groove.

3. A combination as set forth in claim 1 wherein a channel means is mounted under the length of said spiral wall pipe is catch condensation therefrom.

4. A combination as set forth in claim 3 including a second pipe located above said spiral wall pipe and spaced therefrom, a water supply, said second pipe being perforated to direct water onto the upper surface of said external spiral grooves of said spiral wall pipe from said water supply to achieve additional evaporative cooling under low humidity conditions.

5. A combination as set forth in claim 1 including a second spiral wall pipe located in a room with said first mentioned spiral wall pipe, said second spiral wall pipe being mounted over said first mentioned spiral wall pipe, said pump means also being connected to said second spiral wall pipe for pumping a coolant through said second spiral wall pipe, valve means controlling the flow of a coolant to said second spiral wall pipe, control means for opening said valve means and increasing the capacity of said pump means to maintain the flow the same as when said coolant is only pumped through said first mentioned spiral wall pipe.

6. A multiple pipe heat exchanger apparatus comprising a plurality of pipes located around a room, said plurality of pipes including a spiral wall pipe for containing a flow of coolant, an elongated drain channel located under said spiral wall pipe, a water supply, a straight pipe for containing a flow of water connected to said water supply positioned over said spiral wall pipe, said straight pipe having openings for directing water onto said spiral wall pipe, valve means for directing water to said straight pipe to achieve evaporative cooling when desired, said spiral wall of said spiral wall pipe receiving some of said water and keeping it against said spiral wall pipe in a curved flow for a longer period of time as it flows over it.

7. A combination as set forth in claim 6 including a first spacer means supporting said spiral wall pipe in said drain channel, second spacer means located between said straight pipe and a spiral wall pipe.

8. A combination as set forth in claim 6 including wall straps for supporting said drain channel around a room, leveling means positioned between said drain channel and said wall straps to obtain a drain flow from said drain channel to a drain outlet.

9. A combination as set forth in claim 6 including a deflector strip for preventing liquids from spraying into a room, said deflector strip being mounted adjacent said drain channel.

10. A combination as set forth in claim 9 including wall straps for supporting said drain channel around a room, said deflector strip being connected to arms extending from said wall straps.

11. A combination as set forth in claim 10 wherein said deflector strips are made decorative to hide said pipes.

* * * * *